United States Patent [19]

Larsen et al.

[11] Patent Number: 4,905,890

[45] Date of Patent: Mar. 6, 1990

[54] CLOSURE FOR NEWSPAPER DELIVERY RECEPTACLE

[76] Inventors: Don G. Larsen; Julie A. Larsen, both of 7900 Steins Hill Rd., Space 20; Connie Mallory, 7900 Steins Hill Rd., Space 9, all of Cashmere, Wash. 98815

[21] Appl. No.: 383,589

[22] Filed: Jul. 24, 1989

[51] Int. Cl.[4] ..... B65D 91/00

[52] U.S. Cl. ..... 232/1 C; 232/45

[58] Field of Search ..... 232/17, 1 C, 45

[56] References Cited

U.S. PATENT DOCUMENTS 3,086,674 4/1963 Scheuerman .
3,144,984 8/1964 Ross .
4,181,250 1/1980 Withrow .
4,260,090 4/1981 Gross ..... 232/1 C X
4,723,702 2/1988 Martin .

*Primary Examiner*—Robert W. Gibson, Jr.
*Attorney, Agent, or Firm*—Cahill, Sutton & Thomas

[57] ABSTRACT

A closure for the open end of a tubular newspaper delivery receptacle is made largely from a flexible fabric sheet. A drawstring at the peripheral edge of the sheet draws the closure tightly against the end of the receptacle. An elastic member affixed to the sheet gathers the central region of the sheet into a series of ruffles surrounding and essentially closing access opening through the closure. A flap on the inside of the closure assists in closing the opening to the elements. The closure may include a hood projecting forwardly from the open end of the receptacle to further shield the opening.

10 Claims, 1 Drawing Sheet

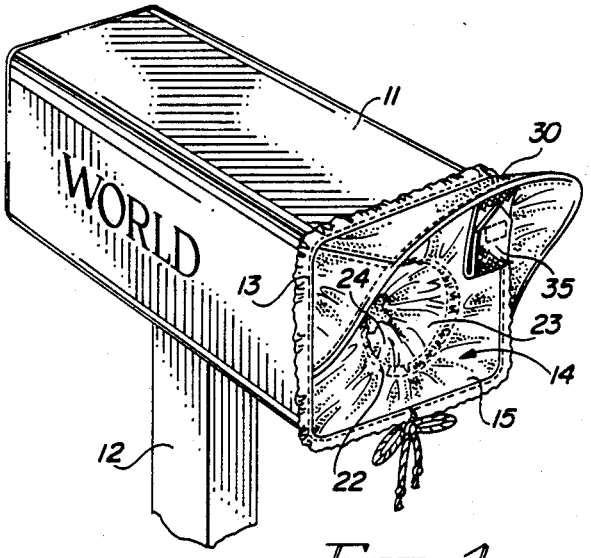
FIG. 1
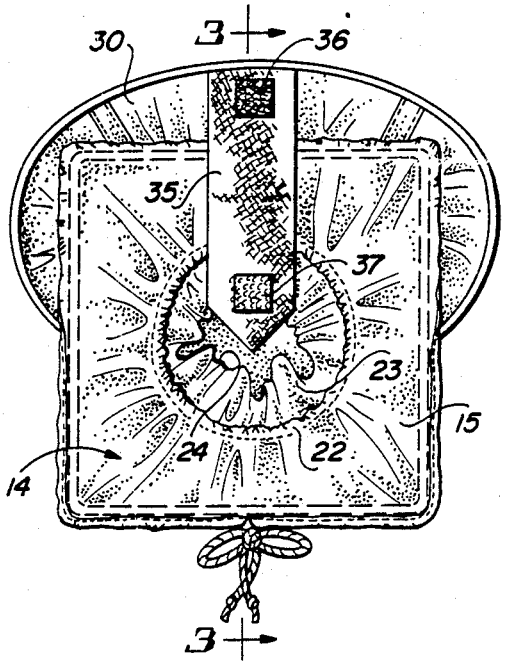
FIG. 2
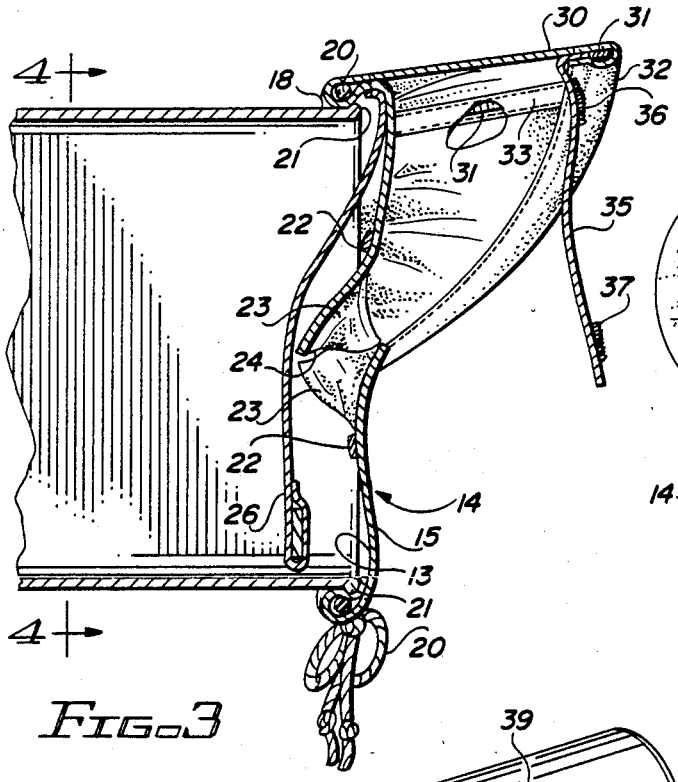
FIG. 3
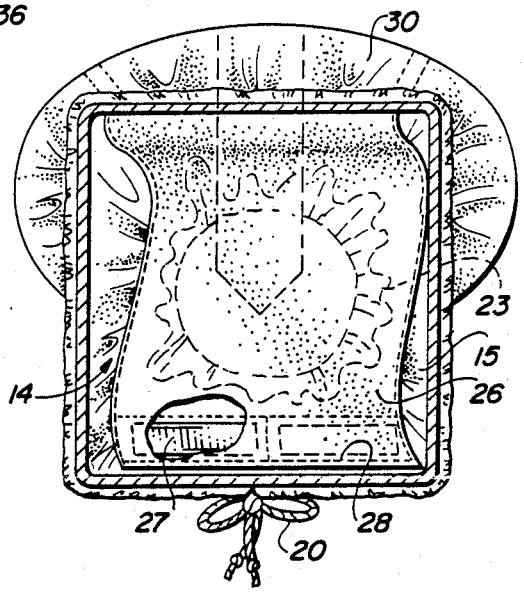
FIG. 4
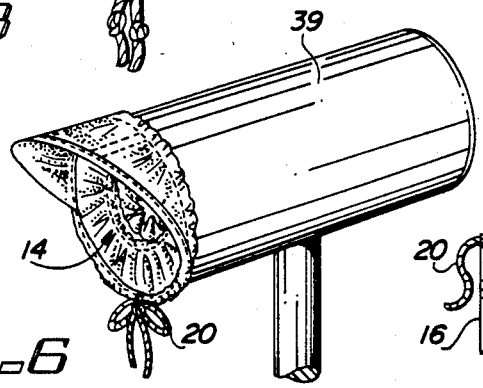
FIG. 6
FIG. 5
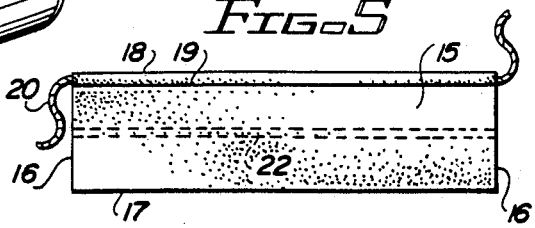

CLOSURE FOR NEWSPAPER DELIVERY RECEPTACLE

TECHNICAL FIELD

This invention is concerned with closing the open end of a newspaper delivery receptacle to prevent precipitation from entering the receptacle.

BACKGROUND ART

Newspaper delivery receptacles in use in rural areas usually are open ended tubular structures formed of metal or plastic. And the receptacles come in a variety of sizes and shapes to meet the requirements or the whims of the newspaper publisher.

A number of prior inventors have recognized the desirability of keeping the newspaper dry and have devised special closures for the open end of the delivery receptacle. R. A. Scheuerman discloses in his U.S. Pat. No. 3,086,674 granted Apr. 23, 1963 for "PROTECTIVE DOOR FOR CONTAINERS" a weatherproof door which is hinged to the newspaper receptacle and has flexible flap means therein through which the newspaper can be inserted. H. C. Ross in his U.S. Pat. No. 3,144,984 granted Aug. 18, 1964 for "WEATHER SHIELD FOR A NEWSPAPER BOX" discloses a snap-in-place shield with a flexible gate which must be raised to permit the paper to be placed in the receptacle. U.S. Pat. No. 4,181,250 granted Jan. 1, 1980 to V. N. Withrow for "NEWSPAPER TUBE CLOSURE" discloses a closure in which a spring biased inner door releases an outer closure door when the inner door is contacted by a newspaper being inserted into the receptacle. U.S. Pat. No. 4,723,702 granted Feb. 9, 1988 to T. B. Martin for "ONE-WAY NEWSPAPER DELIVERY RECEPTACLE" suggests placing a gravity actuated gate inside the receptacle near its open end.

All four of the closure arrangements disclosed in the patents identified in the preceding paragraph share a significant disadvantage. They were all designed and fabricated to fit a newspaper receptacle having a particular size and a particular configuration. None of these closures lend themselves to use with a variety of receptacles. Certainly, none are adaptable to both rectangular and circular cross-sectioned receptacles. And because the closures of these four patents are expensive to manufacture it is not entirely practical to fabricate a limited number for but one or two types of receptacles.

There continues to be a need for a closure for newspaper delivery receptacles which can reliably keep the newspaper dry, provide for ease of insertion and removal of the newspaper and which is readily adaptable to a variety of receptacles having different shapes and sizes.

DISCLOSURE OF THE INVENTION

One of the principal features of the closure of the present invention is that it is fabricated in large measure of flexible sheet fabric material. This provides a great deal of versatility for mounting the closure on receptacles differing in size and shape. The main body of the closure comprises an elongated strip of fabric having its two ends joined so that it forms a tube-like structure with rear and forward edges. This strip includes means along its rear edge for fastening the closure around the delivery receptacle. Intermediate the rear and forward edges of the fabric strip is elastic means which causes the strip to pucker and form ruffles at the outer edge of the strip. The elastic pulls the fabric strip across the opening in the paper delivery receptacle with the ruffled edge providing an opening through which the newspaper can be inserted into and removed from the receptacle.

If desired, the closure may also include a flap positioned at the inner face of the closure and a hood member projecting forwardly over the closure to reduce the likelihood of precipitation entering the receptacle. A flag may also be provided at the hood to signal the presence of a paper in the receptacle.

BRIEF DESCRIPTION OF THE DRAWING

The invention is described in greater detail hereinafter by reference to the accompanying drawing wherein:

FIG. 1 is a perspective view from above of a newspaper delivery receptacle equipped with a closure constructed in accordance with this invention;

FIG. 2 is an enlarged front elevational view of the closure;

FIG. 3 is a vertical sectional view through the closure taken as indicated by line 3—3 in FIG. 2;

FIG. 4 is a vertical sectional view through the receptacle taken as indicated by line 4—4 in FIG. 3 and showing the rear face of the closure;

FIG. 5 is a plan view of a sheet of fabric employed to form the main body of the closure; and FIG. 6 is a perspective view from above showing the closure applied to a newspaper receptacle of a different shape.

BEST MODES FOR CARRYING OUT THE INVENTION

Referring to FIG. 1 the numeral 11 identifies a conventional newspaper delivery receptacle used for rural delivery. The receptacle 11 usually is positioned on a post 12, or other support, alongside a road where it is convenient to a delivery person in an automobile.

The paper receptacle 11 typically is open at its forward end 13 to facilitate insertion of the newspaper. And because the receptacle is exposed to the elements, rain and snow can enter the open end of the receptacle and wet the newspaper therein. This invention is concerned with keeping precipitation out of the receptacle 11 while permitting easy insertion and removal of a newspaper.

Fitted over the open end 13 of receptacle 11 is a closure identified generally by reference numeral 14. The main body of the closure 14 is fabricated from a sheet 15 of tough, water resistant flexible fabric made of durable material such as nylon. Sheet 15 initially has the configuration shown in FIG. 5 in which it is an elongated piece of material having ends 16 which are to be joined, as by sewing, and front and rear edges 17 and 18.

The rear edge 18 of closure sheet 15 is adapted to be secured in contact with the receptacle 11 at the open end 13 of the receptacle. For this purpose edge 18 of sheet 15 has a casing 19 formed therealong for receiving a drawstring 20. The drawstring 20 constitutes means for securing the closure 14 on the end of receptacle 11. This attachment is more secure if the receptacle 11 has a bead 21 around its open end.

Secured to the sheet 15 throughout its length intermediate forward edge 17 and rear edge 18 is an elastic strip 22. (See FIG. 5). Strip 22 is affixed, as by sewing, to the fabric strip 15 in a stretched condition so that when the rear edge 18 of the strip is wrapped around the end of the receptacle 11 the intermediate region of the strip 15 and forward edge 17 are drawn inwardly across the open end 13 of the receptacle by the elastic strip 22. Fabric strip 15 is formed into a series of ruffles 23 occupying what essentially is a circular opening 24 through closure 14.

The ruffles 23 forming the opening 24 in closure 14 are sufficiently flexible to permit a hand-held newspaper to be inserted through the closure 14. The ruffled region of the closure 14 is pushed aside by the newspaper and the delivery person is not required to manipulate the closure in any other manner. Similarly, the subscriber can reach in with one hand, grasp and extract the newspaper through the closure 14 without further manipulation of the closure. In each instance the elastic strip 22 insures that the closure ruffles 23 form a shield to essentially prevent the entry through closure 14 of precipitation.

If desired, the newspaper can be further shielded from precipitation entering receptacle 11 through closure 14 by a flap member 26 secured to that portion of the rear edge 18 of sheet 15 which extends across the top of the open end 13 of receptacle 11. (See FIGS. 3 and 4). Weights 27 positioned in a hem 28 at the lower edge of flap 26 hold the flap down against the opening 24 through closure 14. However, because the lower and side edges of flap 26 are free the flap is easily pushed upwardly when a newspaper is being inserted into or removed from the receptacle 11. Flap 36 is preferably fabricated from the same fabric as is closure strip 15.

Further if desired, closure 14 can be equipped with a hood, or bill, 30 to deflect precipitation away from the opening 24 through the closure. Hood 30 is also preferably made from the same fabric as strip 15 and is secured along its rear edge, as by sewing, to the rear edge of strip 15. In this manner the hood extends across the top and partially down the sides of the open end 13 of receptacle 11 and projects forwardly of the closure. The hood 30 may have boning stiffeners 31 sewn into its forward edge 32 and at other locations 33 extending from front to rear of the hood. (See FIG. 3).

A final feature of the closure of this invention is a signal flag 35 depending from the forward edge 32 of hood 30. Flag 35 comprises an elongated strip of fabric having the components 36 and 37 of a fabric fastener positioned, respectively, near the upper and lower ends of the strip. (See FIGS. 2 and 3). When the flag 35 is folded so that the fastener components 36 and 37 come into secure engagement the flag is held in an inconspicuous position adjacent the hood 30. (See FIG. 1). When fastener components 36 and 37 are separated the flag assumes an elongated posture (FIG. 2) in which it is visible to indicate the presence of a newspaper inside the receptacle 11. Flag 35 is preferably made of the same fabric as closure strip 15, but in a contrasting color to enhance its visibility.

From the foregoing it should be apparent that this invention provides an effective closure for a newspaper delivery receptacle through which a newspaper can easily be inserted and removed. The versatility of the closure 14 is illustrated in FIG. 6 in which the closure is shown affixed to a delivery receptacle 39 having a circular cross-section quite different from the configuration of receptacle 11 of FIG. 1. The flexibility of the closure strip 15 and the use of drawstring securing means 20 allows the closure to be fitted to receptacles of differing shapes and sizes.

What is claimed is:

1. The combination with a newspaper delivery receptacle comprising a tubular structure open at one end and a closure for the open end of the receptacle, said closure comprising an elongated strip of flexible material having a rear edge and an opposite forward edge along its longer dimension, said rear edge of said strip being wrapped around the open end of the receptacle, means for securing said rear edge of the strip in contact with said receptacle, elastic means secured to said strip intermediate its rear and forward edges, said elastic means gathering said strip in ruffles across the open end of the receptacle to provide a flexible closure for the receptacle, said strip being sufficiently flexible to permit partial separation of the ruffles in said strip for insertion and removal of a newspaper through the ruffles in said strip.

2. The combination recited in claim 1 further characterized in that said means for securing said rear edge of the closure strip in contact with said receptacle comprises a drawstring in a casing along the rear edge of the cover strip, whereby the cover can be secured to receptacles of different dimensions.

3. The combination recited in claim 1 further characterized in that there is a hood secured to the rear edge of said cover strip in position to project forwardly of the open end of the receptacle.

4. The combination recited in claim 1 further characterized in that said cover has a flap member secured at one edge to said strip and extending downwardly over the ruffles in said strip on the side of the cover facing the interior of the receptacle.

5. The combination recited in claim 4 further comprising a weight member carried by said flap member at an edge opposite said one edge.

6. The combination recited in claim 3 further comprising a signal flag comprised of an elongated strip of flexible material, said signal strip having one end attached to said hood, said signal strip being folded on itself and having means for fastening the end opposite said attached end to the strip to hold said signal strip in its folded condition.

7. The combination with a newspaper delivery receptacle comprising a tubular structure open at one end and a closure for the open end of the receptacle, said closure comprising a sheet of flexible material having its periphery wrapped around the open end of the receptacle, means for securing the periphery of said sheet in contact with said receptacle, said sheet having an opening through a central region thereof, an elastic means secured to said sheet around said opening, said elastic means gathering said sheet and ruffles at the opening in the sheet to provide a flexible closure for the opening in the sheet, said ruffles permitting insertion and removal of a newspaper through the sheet.

8. The combination recited in claim 7 further characterized in that said means for securing the periphery of said sheet in contact with said receptacle comprises a drawstring, whereby the cover can be secured to receptacles of different dimensions.

9. The combination recited in claim 7 further characterized in that there is a hood secured to an upper region of said sheet in position to project forwardly of the open end of the receptacle.

10. The combination recited in claim 7 further characterized in that the cover has a flap member secured at one edge to an upper region of said sheet and extending downwardly over the ruffles in said sheet on the side of the cover facing the interior of the receptacle.

* * * * *